US006226812B1

(12) United States Patent
Ker

(10) Patent No.: US 6,226,812 B1
(45) Date of Patent: May 8, 2001

(54) FAUCET HAVING THE SHAPE OF A STANDARD DESK PHONE

(75) Inventor: Wun-Chi Ker, Chunghua County (TW)

(73) Assignee: Shang-Jyi Sanitary Equipment Ke Co., Ltd., Chunghua County (TW)

( * ) Notice: Subject to any disclaimer, the term of this patent is extended or adjusted under 35 U.S.C. 154(b) by 0 days.

(21) Appl. No.: 09/578,039

(22) Filed: May 25, 2000

(51) Int. Cl.[7] ..... A47K 3/20; B05B 1/00
(52) U.S. Cl. ..... 4/615; 239/211; D23/215
(58) Field of Search ..... 4/615; 137/801; 239/211; D23/215

(56) References Cited

U.S. PATENT DOCUMENTS 4,821,960 * 4/1989 Goldman ..... 4/661 X

FOREIGN PATENT DOCUMENTS

0393206 * 5/1965 (CH) ..... 4/615
1112245 * 3/1956 (FR) ..... 4/615

* cited by examiner

*Primary Examiner*—Charles E. Phillips
(74) *Attorney, Agent, or Firm*—Harrison & Egbert

(57) ABSTRACT

A faucet is shaped like a rotary dial phone and is formed of a main body, a water-controlling bolt, a water valve, a control plate, and a spray head. The main body is provided with a first water outlet which is in communication with one end of the spray head, and a second water outlet which is in communication with the first water outlet via a channel. The water-controlling bolt is movably positioned in a hole of the main body such that the water-controlling bolt can be caused to obstruct the first water outlet or the channel. The water valve is secured in place in a receiving slot of the main body and is provided with a connection rod to which the control plate is rotatably connected. The spray head is removably positioned on the water-controlling bolt such that the spray head is connected at one end to a hose which is in turn connected at one end to the water controlling bolt.

1 Claim, 6 Drawing Sheets

FAUCET HAVING THE SHAPE OF A STANDARD DESK PHONE

BACKGROUND OF THE INVENTION

1. Field of the Invention

The present invention relates generally to a faucet, and more particularly to a faucet which is shaped like a standard desk phone.

2. Description of Related Art

The conventional faucets are rather limited in design of the shape in view of the limitation in configuration of water controlling parts of the faucets. In order to design a faucet having an attractive profile, the structural configuration of the faucet must be changed.

BRIEF SUMMARY OF THE INVENTION

The primary objective of the present invention is to provide a faucet which is shaped like a standard desk phone and is provided with means for easy switching of hot water and cold water.

The features and the advantages of the present invention will be readily understood and appreciated upon a thoughtful deliberation of the following detailed description of a preferred embodiment of the present invention with reference to the accompanying drawings.

DETAILED DESCRIPTION OF THE INVENTION

Figure 1:
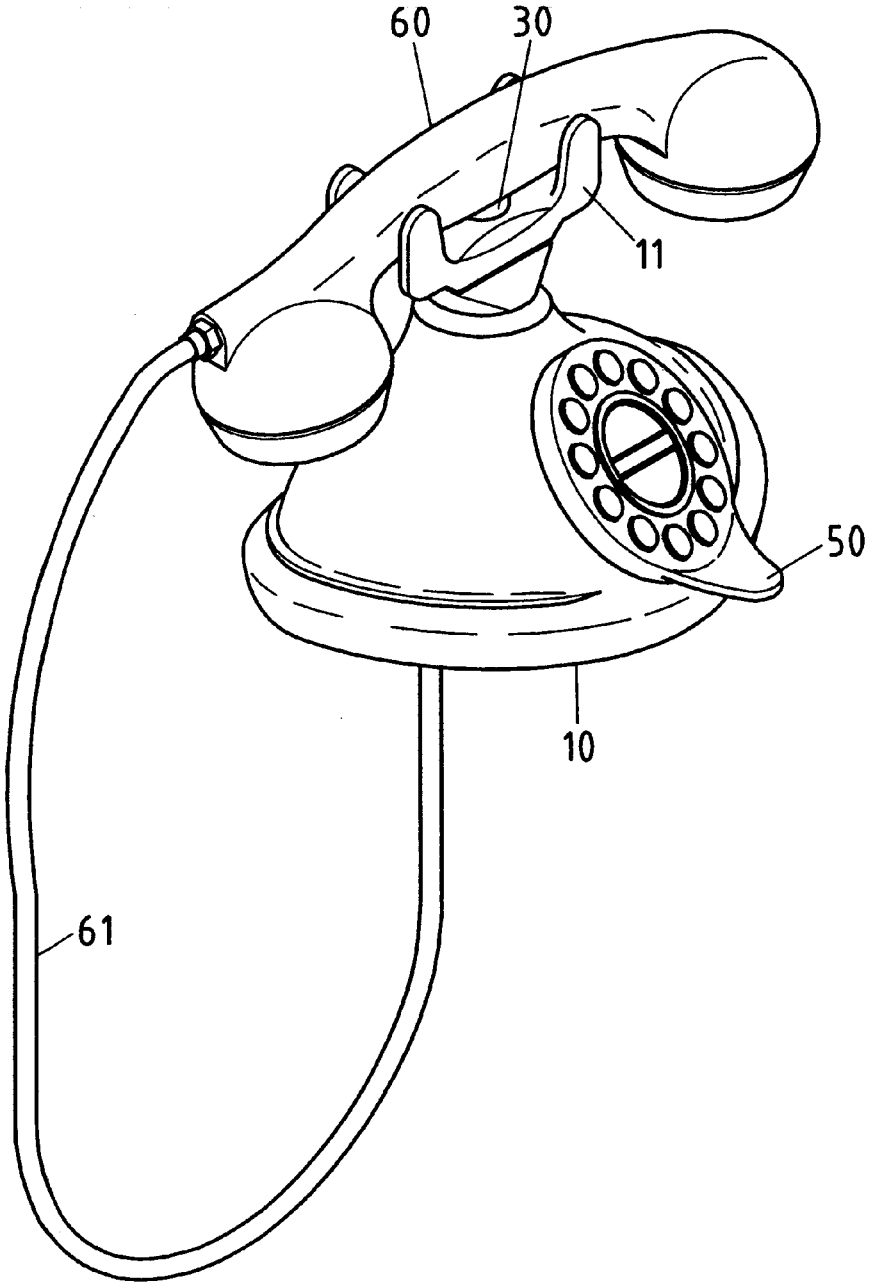
FIG. 1 shows a perspective view of the preferred embodiment of the present invention.
Figure 2:
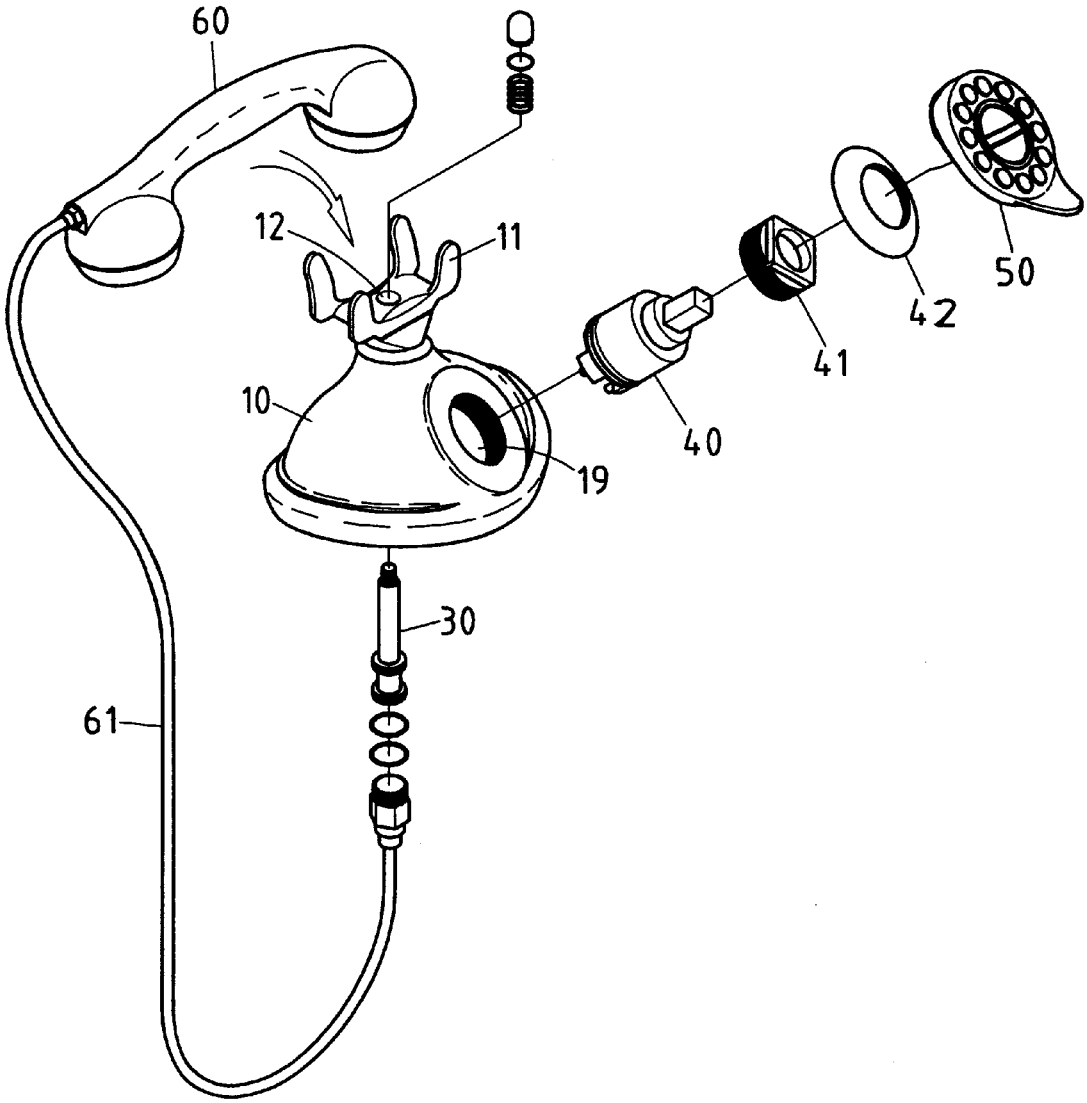
FIG. 2 shows an exploded view of the preferred embodiment of the present invention.
Figure 3:
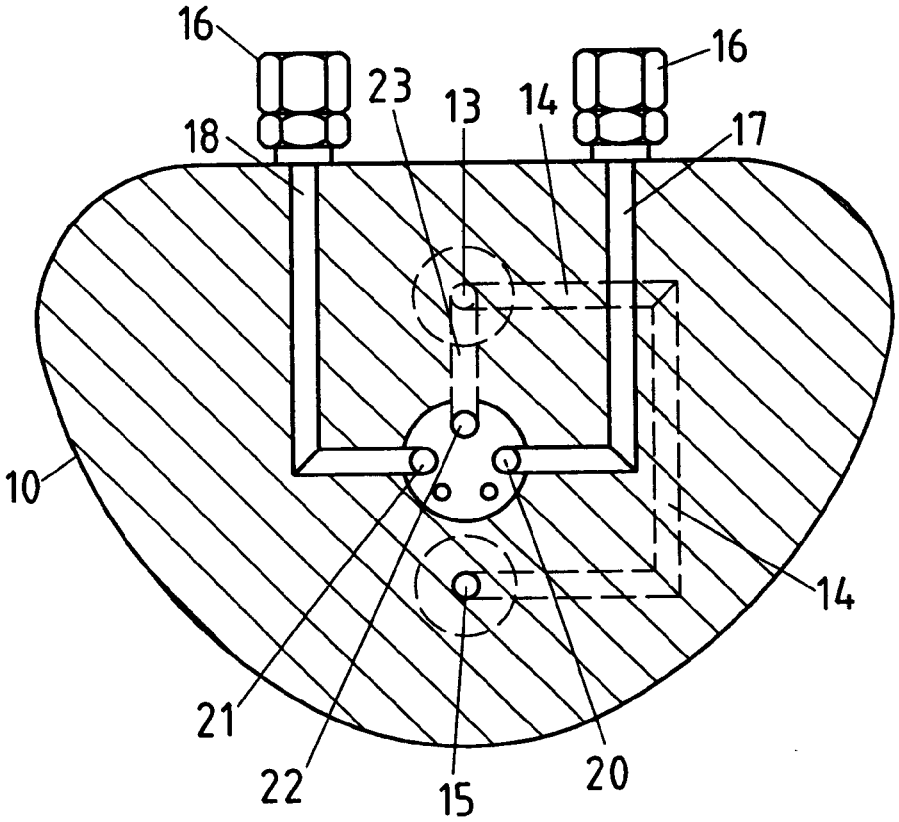
FIG. 3 shows a top sectional view of the preferred embodiment of the present invention.
Figure 4:
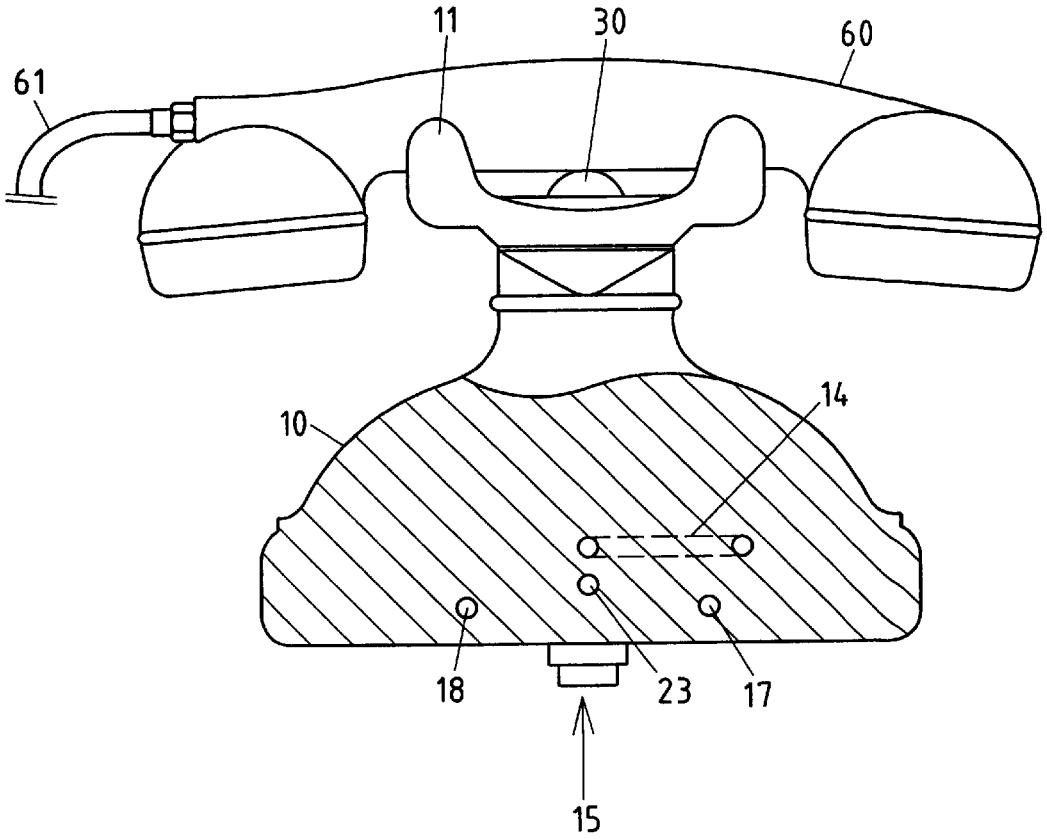
FIG. 4 shows a front sectional view of the preferred embodiment of the present invention.
Figure 5:
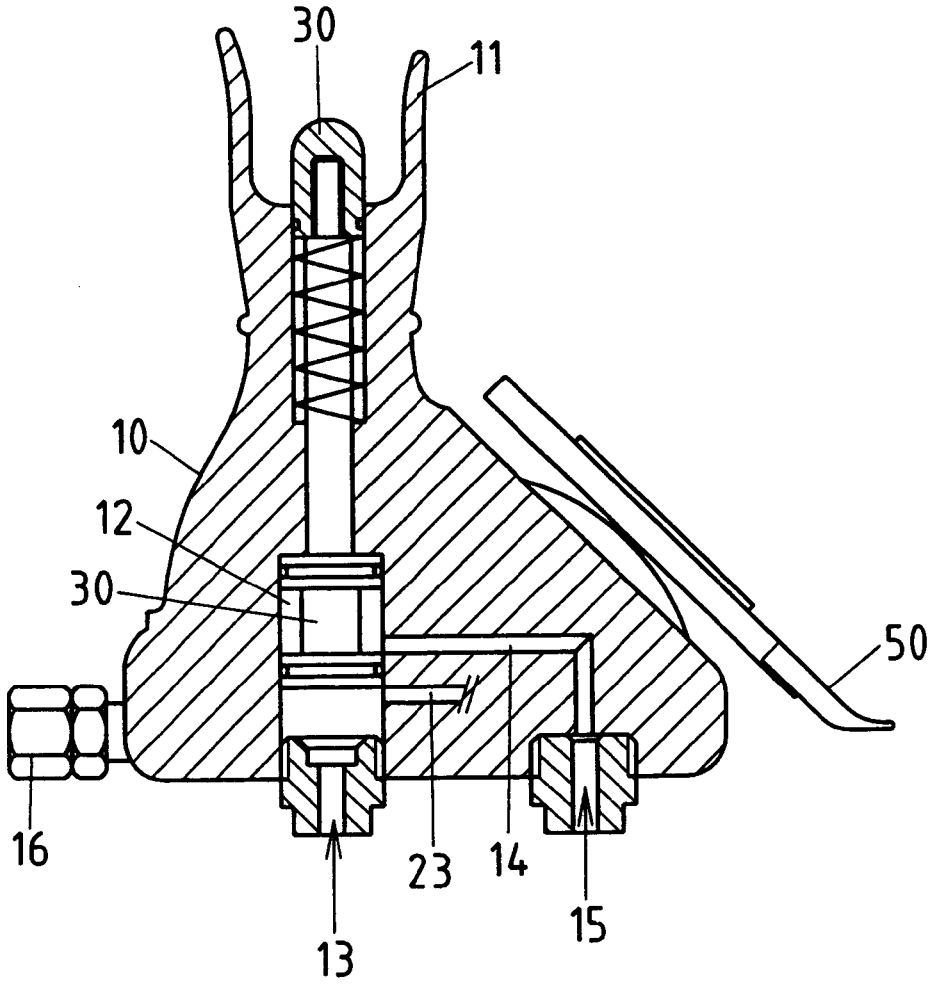
FIG. 5 shows a sectional view of a first water outlet of the preferred embodiment of the present invention at work.
Figure 6:
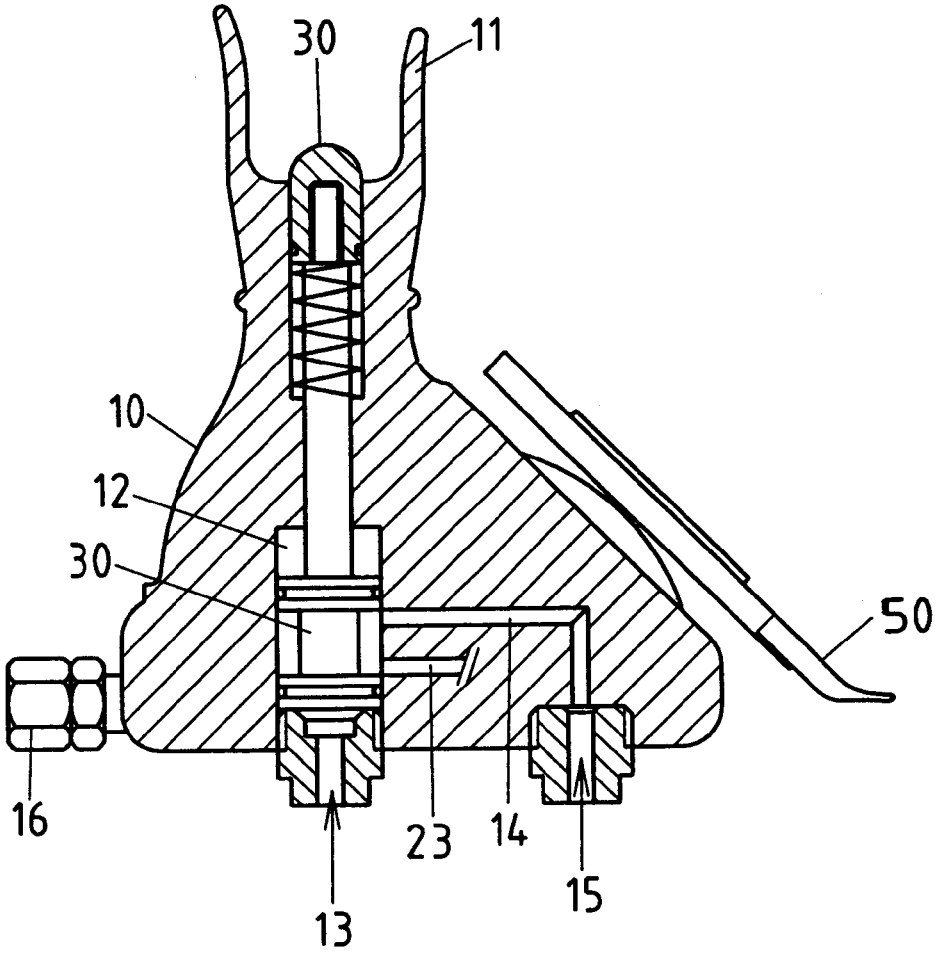
FIG. 6 shows a sectional schematic view of a second water outlet of the preferred embodiment of the present invention.

As shown in all drawings provided herewith, a faucet embodied in the present invention comprises a main body 10, a water-controlling bolt 30, a valve 40, and a spray head 60.

The main body 10 corresponds to the phone base of a standard desk phone and is provided in the top with a support frame 11 which is in turn provided in the center with a through hole 12. The main body 10 is provided in the bottom with a first water outlet 13 and a second water outlet 15. The first water outlet 13 is in communication with the through hole 12 of the support frame 11 and is connected to the second water outlet 15 by a channel 14. The main body 10 is further provided in the rear side with two connectors 16 for connecting respectively to a cold water pipe and a hot water pipe. The two connectors 16 are in communication with the interior of the main body 10 via a cold water duct 17 and a hot water duct 18. The main body 10 is further provided with a receiving slot 19 which is provided in the bottom with a cold water inlet 20, a hot water inlet 21, and a guide port 22. The cold water inlet 20 is in communication with the cold water duct 17. The hot water inlet 21 is in communication with the hot water duct 18. The guide port 22 is in communication with the first water outlet 13 via a passageway 23.

The water-controlling bolt 30 is received in the through hole 12 of the main body 10 such that the bottom end of the water-controlling bolt 30 is capable of obstructing the first water outlet 13 or the channel 14.

The valve 40 is positioned in the receiving slot 19 of the main body 10 such that the valve 40 is secured in place by a nut 41 in conjunction with a fitting member 42. The nut 41 has outer threads which are engaged with inner threads of the receiving slot 19 of the main body 10. The valve 40 has a connection rod which juts out of the main body 10 to connect a control plate 50 which is shaped like the rotary dial of a standard desk phone.

The spray head 60 is similar in shape to a handset of the standard desk phone and is rested on the support frame 11 of the main body 10. The spray head 60 is connected at one end thereof with a hose 61 via which the spray head 60 is in communication with the first water outlet 13 of the main body 10.

In operation, the spray head 60 is lifted such that the water-controlling bolt 30 is relieved of the force exerted thereon, thereby opening the first water outlet 13. The switching of cold water and hot water is controlled by dialing the control plate 50. The cold water and the hot water are let out of the other end of the spray head 60 via the cold water duct 17, the hot water duct 18, the cold water inlet 20, the hot water inlet 21, the guide port 22, the passageway 23, and the hose 61. As the spray head 60 is put back to rest on the support frame 11 such that the spray head 60 forces the water-controlling bolt 30 to move downward to obstruct the first water outlet 13, the water is forced to flow out of the second water outlet 15 via the channel 14, thereby resulting in the temporary cessation of water supply to the spray head 60. It is therefore readily apparent that the faucet of the present invention can be easily operated.

The preferred embodiment of the present invention described above is to be regarded in all respect as being merely illustrative and not restrictive. Accordingly, the present invention may be embodied in other specific forms without deviating from the spirit thereof. The present invention is therefore to be limited only by the scope of the following appended claim.

What is claimed is:

1. A faucet comprising:

a main body similar in shape to the phone base of a standard rotary dial phone and provided in a top with a support frame which is in turn provided with a through hole, said main body provided in a bottom with a first water outlet and a second water outlet, said first water outlet being in communication with said through hole of said support frame such that said first water outlet in connected to said second water outlet by a channel, said main body further provided with two connectors and a receiving slot having inner threads, said two connectors being connected to a cold water pipe and a hot water pipe such that said two connectors are in communication with an interior of said main body via a cold water duct and a hot water duct, said receiving slot provided in a bottom thereof with a cold water inlet, a hot water inlet, and a guide port, said cold water inlet being in communication with said cold water duct, said hot water inlet being in communication with said hot water duct, said guide port being in communication with said first water outlet via a passageway;

a water-controlling bolt movably received in said through hole of said support frame of said main body such that one end of said water-controlling bolt can be caused to obstruct said first water outlet or said channel;

a valve secured in place in said receiving slot of said main body in conjunction with a nut and a fitting member, said valve having a connection rod whereby said connection rod juts out of said main body;

a control plate rotatably connected to said connection rod of said value; and a spray head removably positioned on said support frame of said main body such that said water-controlling bolt is forced downwardly by the weight of said spray head, said spray head being connected at one end thereof to said first water outlet of said main body by a hose whereby said hose is connected at one end thereof to said water controlling bolt.

* * * * *